US006079787A

United States Patent [19]

Nichols et al.

[11] Patent Number: 6,079,787

[45] Date of Patent: Jun. 27, 2000

[54] ARMREST MECHANISM FOR DENTAL CHAIRS

[76] Inventors: Kurt O. Nichols, c/o Marus Dental Intrnational, 20554 Builders St., Bend, Oreg. 97701; Edwin L. Pate, 678 Ave. 21, Los Angeles, Calif. 90031

[21] Appl. No.: 09/230,608

[22] PCT Filed: Jul. 26, 1996

[86] PCT No.: PCT/US96/12306

§ 371 Date: Apr. 12, 1999

§ 102(e) Date: Apr. 12, 1999

[87] PCT Pub. No.: WO98/04171

PCT Pub. Date: Feb. 5, 1998

[51] Int. Cl.[7] ..... A47C 7/54

[52] U.S. Cl. ..... 297/411.39; 297/411.35

[58] Field of Search ..... 297/411.39, 411.35, 297/411.38, 411.32, 411.3, 411.29, 411.2, 411.26, 354.12, 378.1, 440.1

[56] References Cited

U.S. PATENT DOCUMENTS

| | | |
|---|---|---|
| 3,661,421 | 5/1972 | Johnson . |
| 3,767,260 | 10/1973 | Limpach . |
| 4,887,866 | 12/1989 | Rusin . |
| 5,364,166 | 11/1994 | Zegeer . |

*Primary Examiner*—Milton Nelson, Jr.
*Attorney, Agent, or Firm*—Trask Britt

[57] ABSTRACT

An armrest mechanism for dental chairs (10) which causes the armrest to track the movement of the chair back (12), has provisions to slide the armrest (14) out of the way for patient entry and exit, and works in conjunction with the chair back cushion (70) to provide upper arm support.

4 Claims, 7 Drawing Sheets

FIG. 1
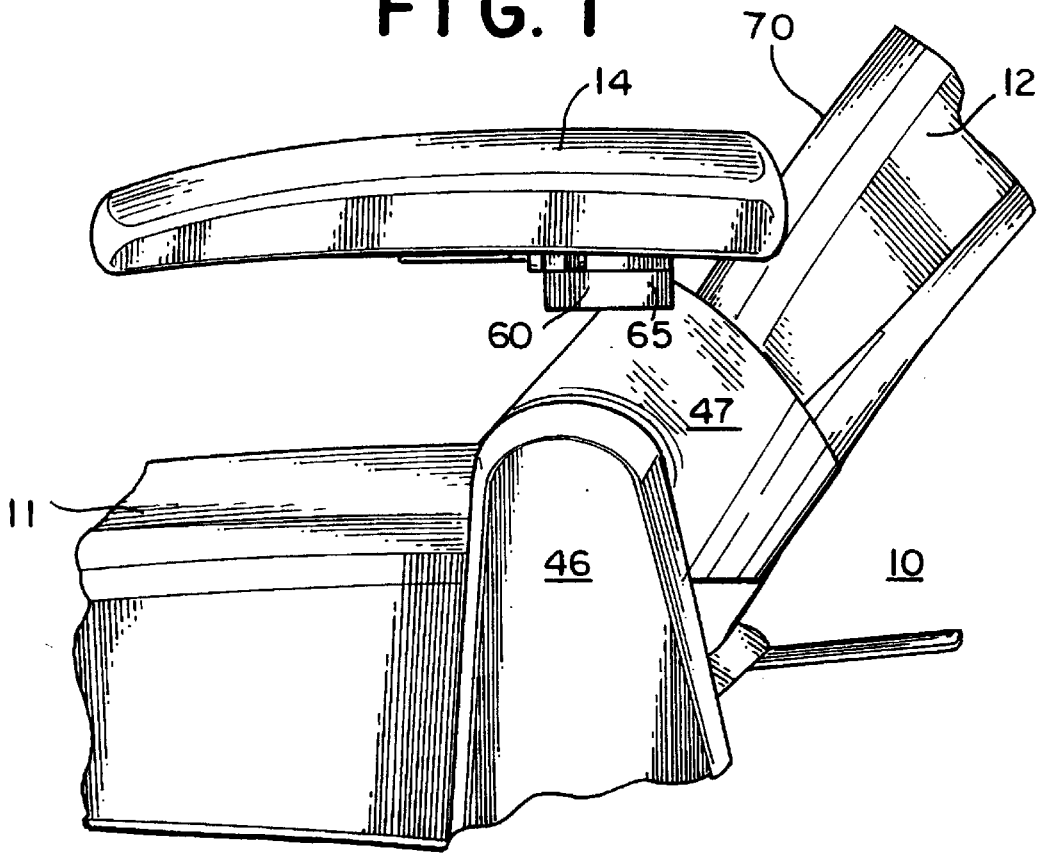
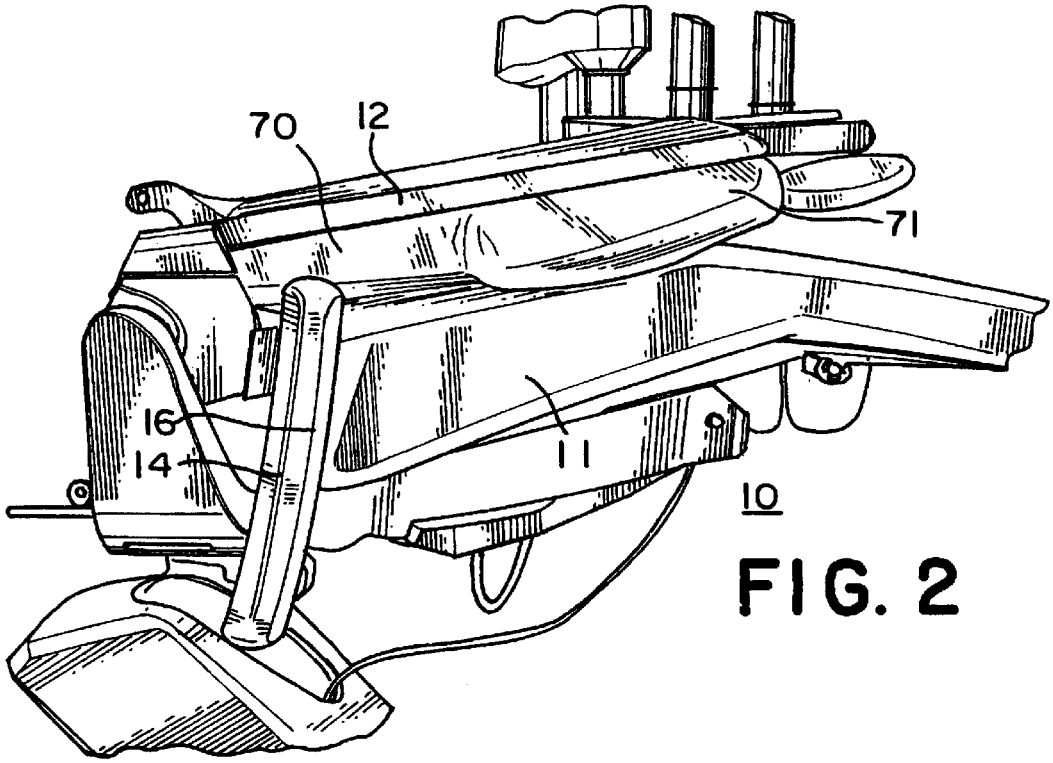
FIG. 2

ARMREST MECHANISM FOR DENTAL CHAIRS

BACKGROUND OF THE INVENTION

1. Field of the Invention

This invention relates to armrest mechanism for dental chairs of the type which causes the armrests to track the movement of the chair back.

2. Description of the Prior Art

On most dental chairs, the armrests do not move with the chair back, with the result that the armrests are not in the most ergonomic position for various inclined positions of the chair back.

Some chairs have been manufactured with sliding armrests, but many chairs with sliding armrests incorporated slings for arm support, which may not provide the support and comfort required by patients.

It is preferable to be able to lower the chair back for shipping, however, it is necessary to do so in a manner that does not complicate shipping, or subsequent installation of the chair in the field.

The armrest mechanism of the invention causes allow the back to be lowered for shipping, but permits easy installation in the field.

SUMMARY OF THE INVENTION

This invention relates to armrest mechanism for dental chairs, which causes the armrests to track the movement of the chair back, to maintain the same relative inclination, which armrests can be slid back for patient entry or exit, and which allows the back to be lowered for shipping, but provides for easy installation in the field.

The principal object of the invention is to provide an armrest mechanism for dental chairs wherein the armrests track the movement of the chair back.

A further object of the invention is to provide armrest mechanism for dental chairs wherein the mechanism includes a quick release trigger to permit the armrests to be slid back for patient entry to and exit from the dental chair.

A further object of the invention is to provide armrest mechanism wherein the armrests work with the chair back cushion to provide upper arm support.

A further object of the invention is to provide armrest mechanism which can be disconnected for lowering the back for shipping, and easily reconnected for chair installation.

A further object of the invention is to provide armrest mechanism which is simple to operate but sturdy and reliable in use.

A further object of the invention is to provide easy entry and exit, by providing arms that slide back to a position that provide a "grab point" that facilitates entry and exit, which is especially helpful to geriatic patients.

Other objects and advantageous features of the invention will be apparent from the description and claims.

DESCRIPTION OF THE DRAWINGS

The nature and characteristic features of the invention will be more readily apparent from the attached description taken in connection with the accompanying drawings in which:

FIG. 1 is a left side elevation view of a dental chair incorporating the armrest mechanism of the invention;

FIG. 2 is a right side elevational view of the chair of FIG. 1 with the chair back fully down for shipping;

Figure 3:
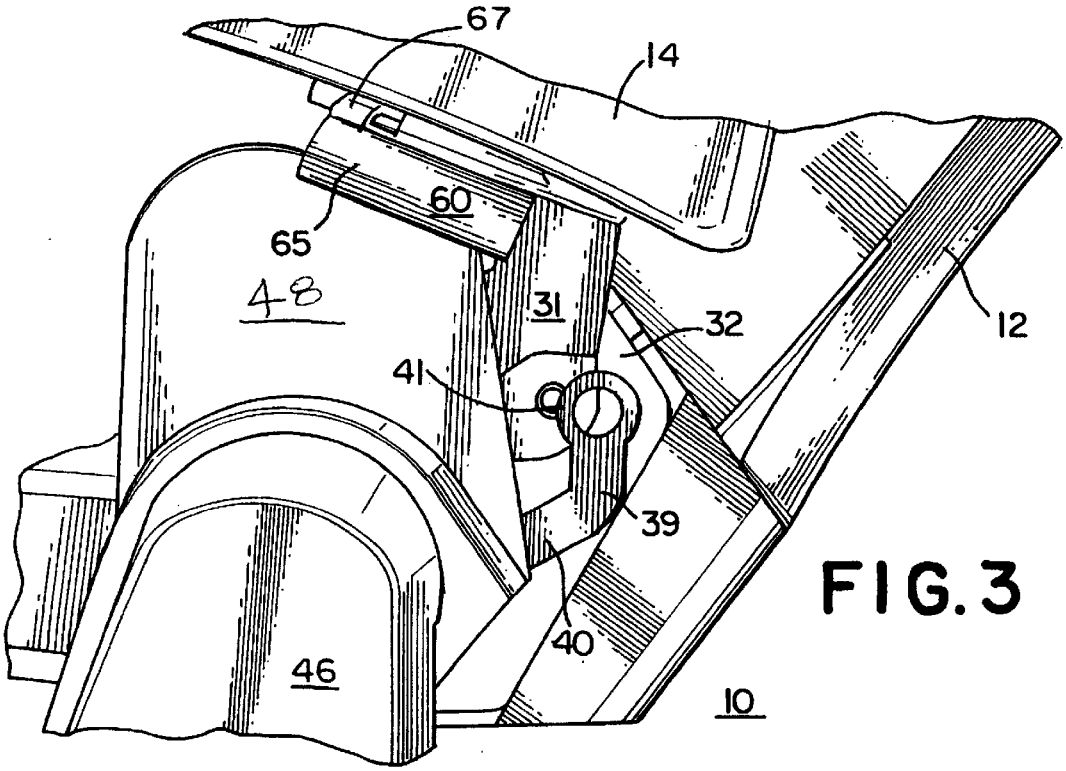
FIG. 3 is a left side elevational view, enlarged, of a portion of the chair of FIG. 1 with the cover out of position to illustrate the armrest mechanism in condition for shipping.
Figure 4:
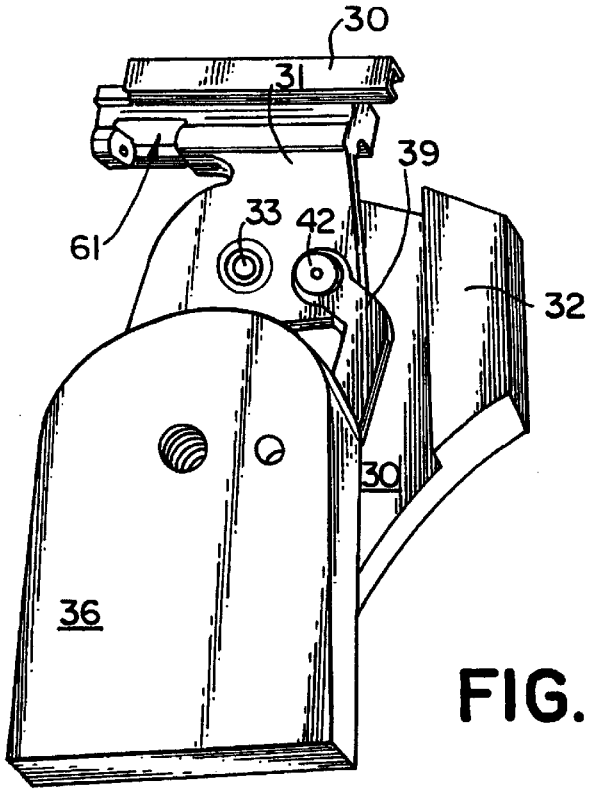
FIG. 4 is a top perspective view of the armrest mechanism of the invention with the cover out of position, illustrating its condition when the back is in an upright position.

It should, of course, be understood that the description and drawings herein are merely illustrative and that various modifications and changes can be made in the structures disclosed without departing from the spirit of the invention.

Like numerals refer to like parts throughout the several views.

DESCRIPTION OF THE PREFERRED EMBODIMENT

When referring to the preferred embodiment, certain terminology will be utilized for the sake of clarity. Use of such terminology is intended to encompass not only the described embodiment, but also technical equivalents which operate and function in substantially the same way to bring about the same result.

Referring now more particularly to FIGS. 1, 2, 3 and 10 of the drawings, a portion of a dental chair 10 is therein illustrated, which includes a seat cushion 11, a seat back 12 which is pivotally attached to the seat frame (not shown), and which is capable of multiple inclined positioning by the dentist for patient support while undergoing dental procedures. The chair 10 has a pair of parallel armrests 14, which include padded cushions 15, preferably covered with a layer of vinyl 16.

Referring additionally to FIGS. 4–9, 11 and 12, the cushions 15 are attached to a substrate 17, which is attached to a slide 20 by screws 21, which also act as stops for the slide 20. The slide 20 is preferably of metal, of elongated rectangular shape, with a top plate 22, side plates 23, and bottom plates 24, with an elongated slot 25 between the plates 24. The slide 20 between top plate 22, side plates 23, and bottom plates 24 has elongated bearings 30 engaged therewith, which are carried by a T-shaped armrest support 31. The armrest support 31 is pivotally attached to a back plate 32 by a shoulder bolt 33, which plate is attached to the seat back 12 by bolts (not shown). The back plate 32 is of semicircular shape, with a center shoulder bolt 35 engaged therewith, and with a frame plate 36 for pivoting the seat back 12. The frame plate 36 has a shoulder bolt 37 therein, which is engaged with one end 38 of a tension link 39. The tension link 39 has a straight portion 40, and an offset portion 41, which is connected to the armrest support 31 by a removable shoulder bolt 42.

Pivoting of seat back 12 about bolt 35 causes back plate 32 to pivot about bolt 35, and to move relative to frame plate 36, which causes link 39 to move in groove 45', and armrest support 31 to pivot about bolt 33. The position of the armrest support 31 is varied and tracks the movement of seat back 12, which movement causes armrests 14 to change position.

Figure 5:
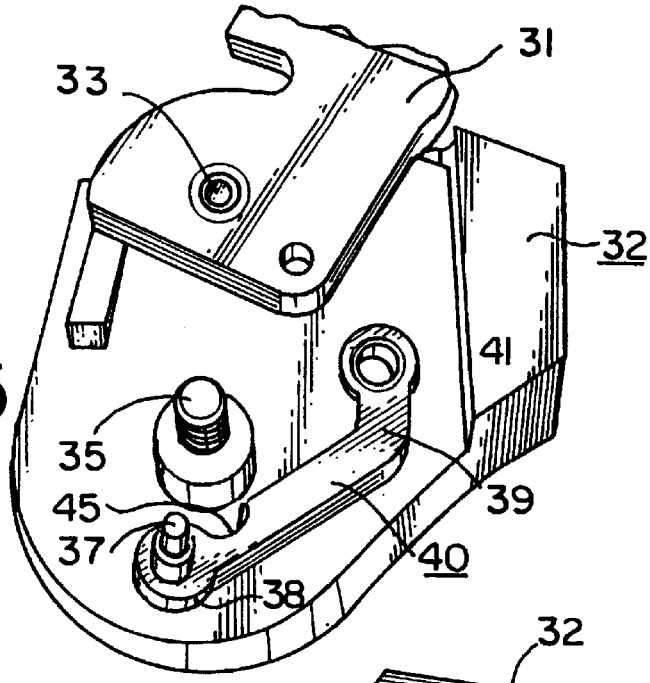
FIG. 5 is a view similar to FIG. 4, with the cover removed to show the link portion of the mechanism of the invention.
Figure 6:
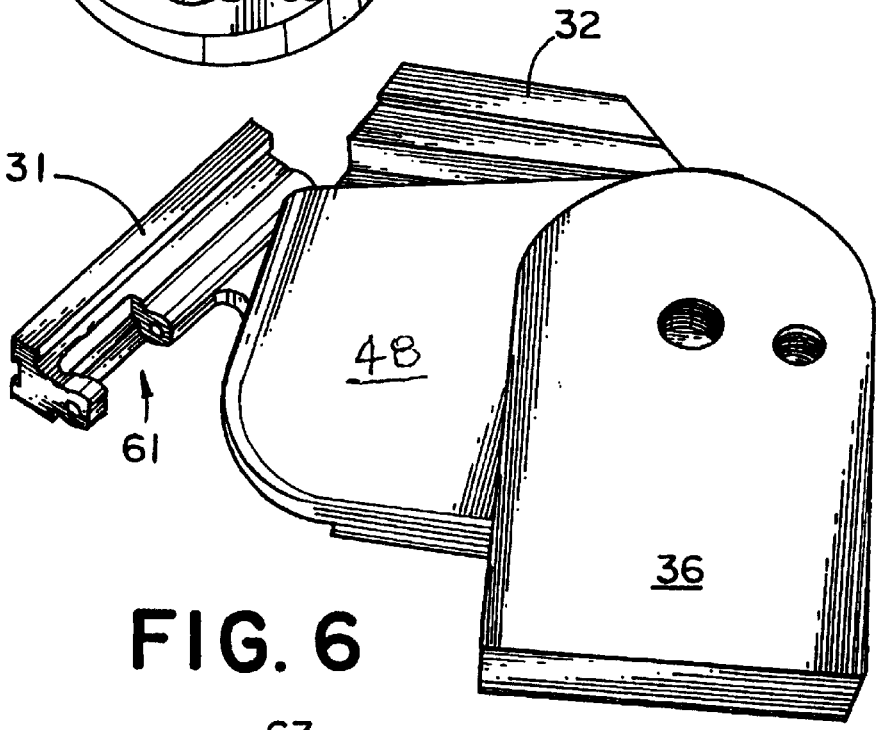
FIG. 6 is a view similar to FIG. 4, illustrating the mechanism in shipping position.
Figure 8:
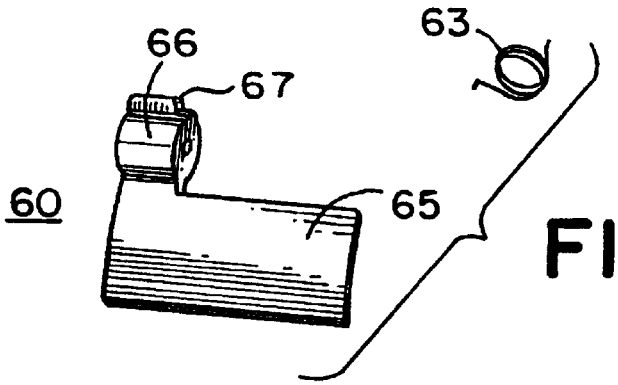
FIG. 8 is a view in perspective of a trigger add spring which are part of the armrest mechanism.
Figure 7:
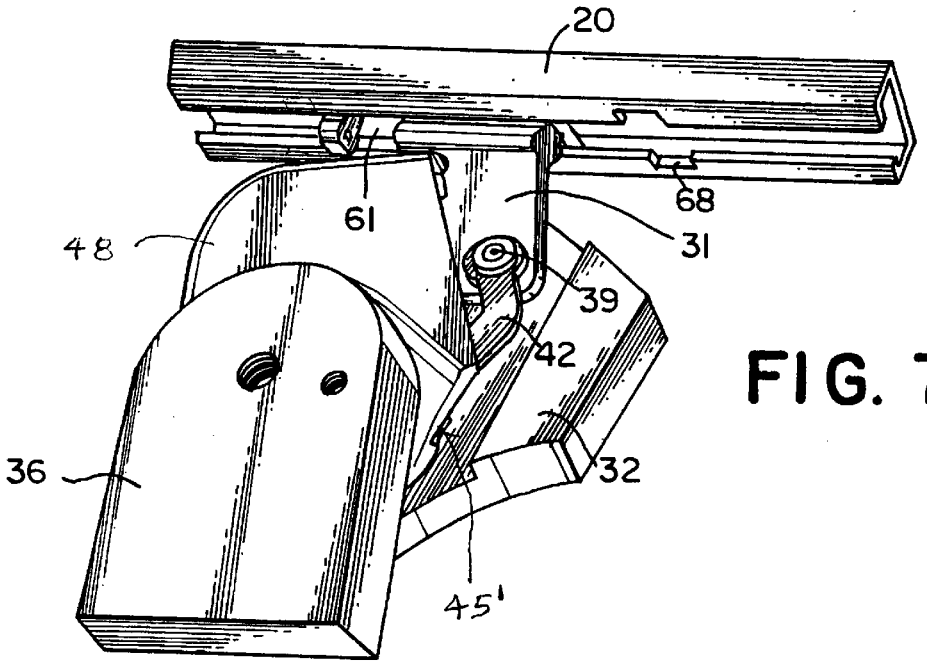
FIG. 7 is a view similar to FIG. 4, illustrating the mechanism in assembled condition.
Figure 9:
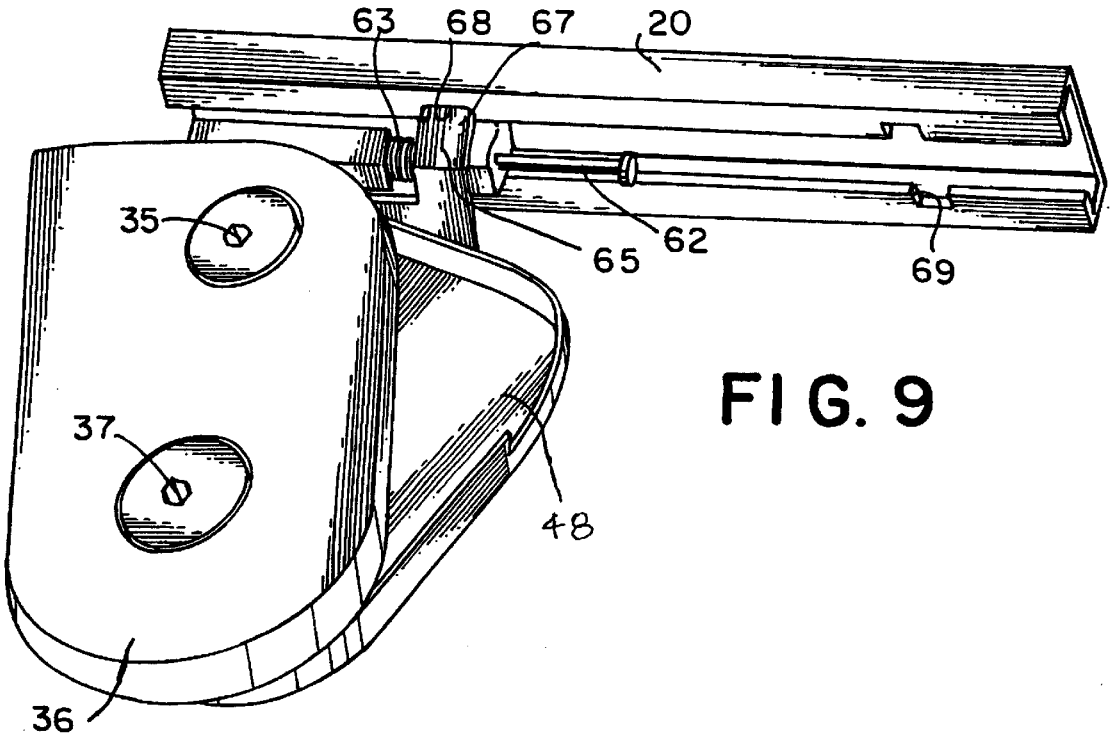
FIG. 9 is a bottom perspective view of the mechanism of FIG. 4.
Figure 10:
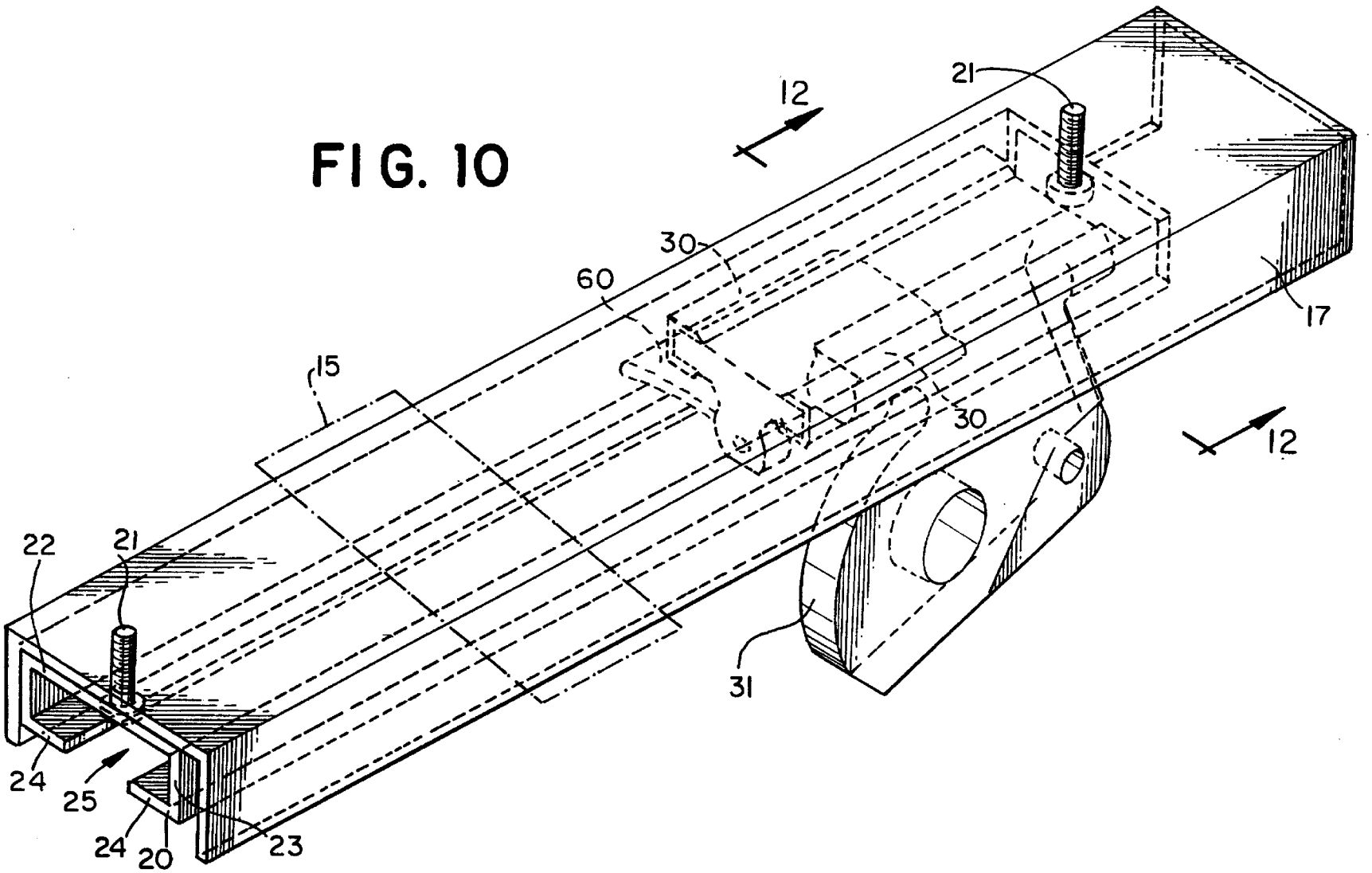
FIG. 10 is a perspective view, in phantom, illustrating a portion of a dental chair, and the release feature of the armrest mechanism.
Figure 11:
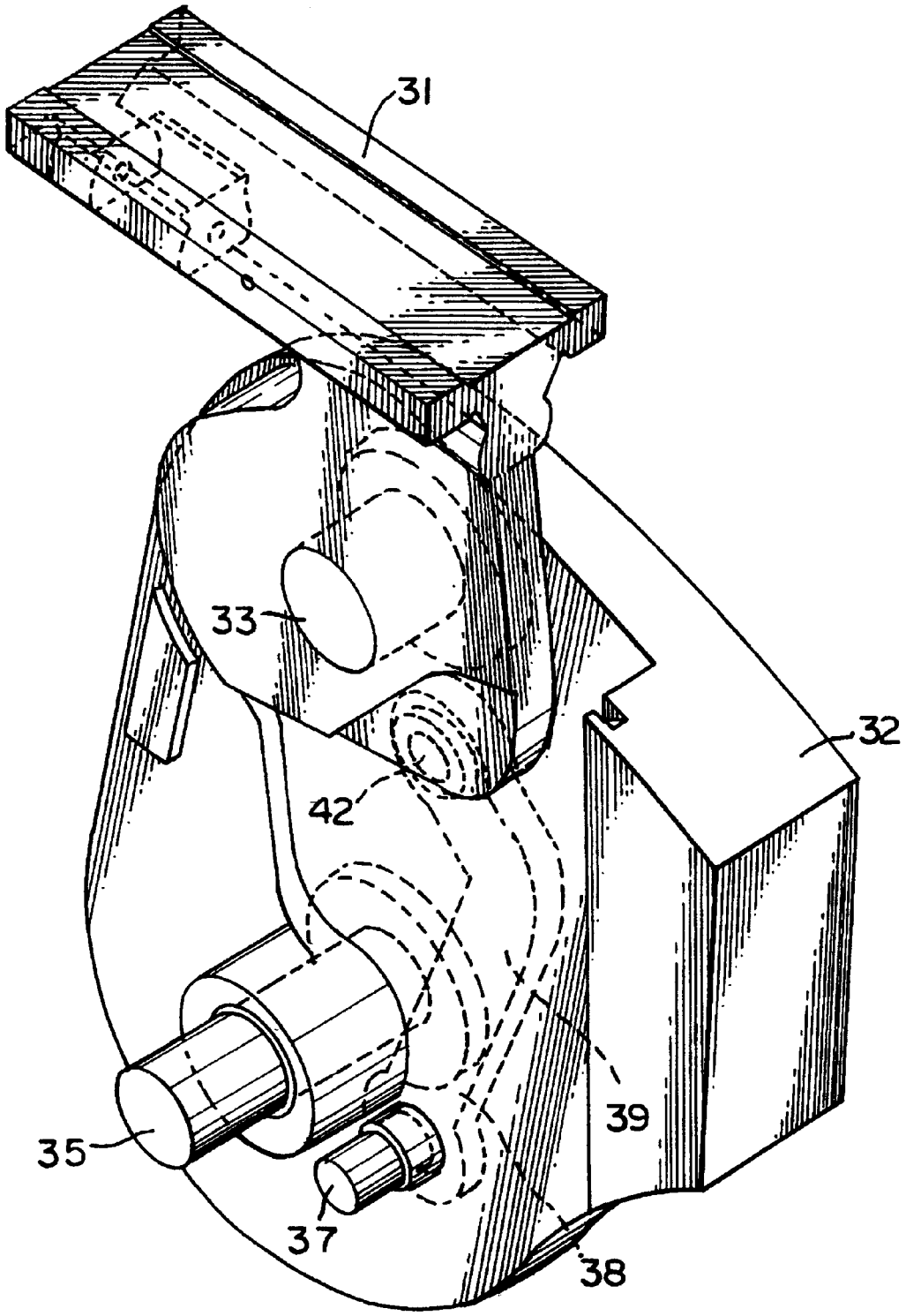
FIG. 11 is a perspective view, in phantom, illustrating the tracking portion of the armrest mechanism.
Figure 12:
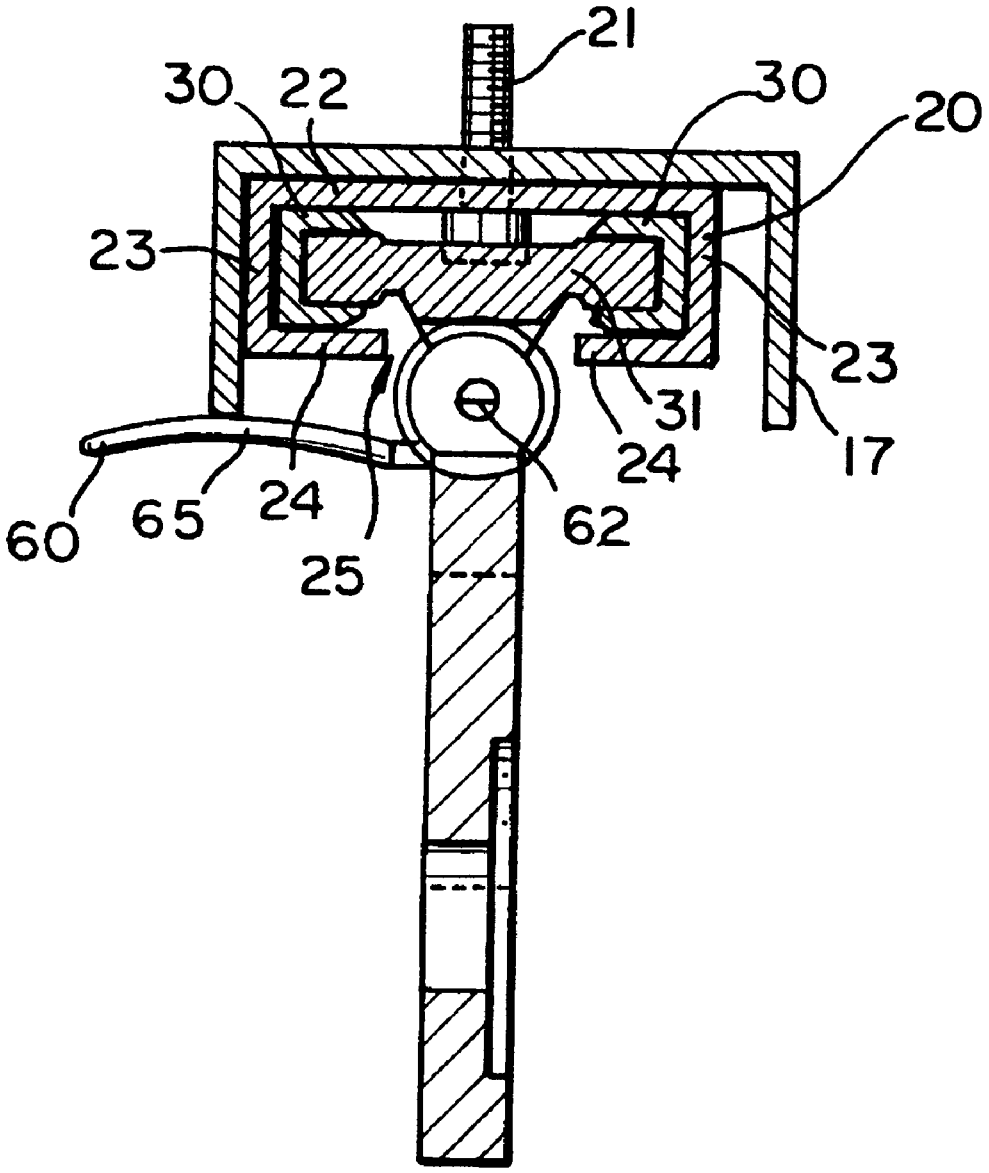
FIG. 12 is a vertical sectional view taken approximately on the line 12—12 of FIG. 11.

The link 39 as shown in FIG. 3, may have the shoulder bolt 42 removed, whereby the armrests supports 31 and armrests 14 are free to move to the position shown in FIG. 2 for shipping. The link 39 is provided with a relief 45, as shown in FIG. 5, for clearance to allow folding of seat back 12 for shipping or other purposes.

The chair 10 may also be provided with removable covers 46, 47, and 48, and which normally conceal plates 36 and 12.

The mechanism is also provided with a trigger 60, which is carried in opening 61 in armrest support 31, and retained therein by pin 62 with a spring 63 thereon. The trigger 60, which is shown in detail in FIG. 8, includes a curved handle 65, with a boss 66 integral therewith, in the opening 61 in armrest support 31, with the pin 62 through the boss 66 retaining it in the support 31.

The boss 66 has a locking lug 67 extending therefrom, which is urged toward slide 20 by spring 63, which slide has cut-outs 68 and 69 therein for lug 67 engagement to lock the armrest 14 in forward or rear position.

The seat back 12 includes a cushion 70 which is filled with a resilient support material of well-known type, and covered with a layer of vinyl 71.

The cushion 70 is designed so that it is wider than the shoulders of the largest person (not shown) who is expected to occupy the chair.

Accordingly, the patient's upper arms (not shown) engage the cushion 70 for all expected positions of the back 12, and the armrests 14 support the patient's lower arms in the same position relative to the seat back 12, and urge the upper arms toward the back cushion 70.

The mode of operation will now be pointed out. When entry or exit from the dental chair 10 is desired, the trigger handles 65 are engaged to rotate against locking springs 63 to urge the lugs 67 out of engagement with cutouts 68, so that armrests 14 can be slid along armrest supports 31 until cutouts 69 are engaged by the lugs 67, and the armrests 14 are in the rearmost position so that the patient can enter or exit the chair without interference from the armrests. The armrests 14 can be slid back to the front position to support the patient's lower arms when in the chair.

When it is desired to position seat back 12, its mechanism (not shown) is actuated and its position changed. The pivoting of seat back 12 about bolts 35 causes links 39 to move armrest supports 31 whereby the armrests 14 track the movement of seat back 12.

When it is desired to position the chair 10 for shipping, the bolts 42 are removed as shown in FIG. 3 so that the seat back 12 and armrests 14 can be positioned as shown in FIG. 1.

It is thus apparent that armrest mechanism for dental chairs has been described with which the objects of the invention are achieved.

What is claimed is:

1. An armrest mechanism for use with a dental chair having a seat cushion and a pivotal chair back, said armrest mechanism comprising:

an armrest, a slide attached to said armrest, a support slidingly engaged with said slide, an ear for pivotal attachment to said chair back, a back support pivotedly engaged with said ear, and a tension link pivotally connected to said armrest support and said back support, whereby pivotal movement of said ear causes said back support to pivot and said tension link to move said armrest support so that a ergonomically correct inclination of said chair back and said armrest is maintained.

2. The armrest mechanism as defined in claim 1 in which said armrest support includes a trigger therein for securing said slide in position, said trigger having locking lugs extending therefrom, said slide defining cutouts therein for engaging with at least one of said locking lugs, and resilient structure on said trigger for urging said locking lugs toward said slide.

3. The armrest mechanism as defined in claim 1 in which said ear has a relief thereon, for link clearance.

4. The armrest mechanism as defined in claim 1 further including a removable cover positioned about said mechanism.

* * * * *

UNITED STATES PATENT AND TRADEMARK OFFICE

CERTIFICATE OF CORRECTION

PATENT NO. : 6,079,787
DATED : June 27, 2000
INVENTOR(S) : Kurt O. Nichols

It is certified that error appears in the above-identified patent and that said Letters Patent is hereby corrected as shown below:

Title page,
Item [76], Inventors, change "Intrnational" to -- International --

Column 1,
Line 16, change "incorporated" to -- incorporate --
Line 23, after "causes" and before "allow" insert -- the armrests to track the position of the chair back, are slidable for patient entry and exit and --

Column 2,
Line 13, change "add" to -- and --

Column 3,
Line 16, after "and" and before "12" insert -- seat back --

Signed and Sealed this

Sixth Day of May, 2003

JAMES E. ROGAN
*Director of the United States Patent and Trademark Office*